United States Patent [19]

Archer et al.

[11] 4,191,935

[45] Mar. 4, 1980

[54] TWIN PATH REED SPRING RELAY CONSTRUCTION

[75] Inventors: Wendel E. Archer, Gahanna; Norman Wasserman, Columbus, both of Ohio; Douglas H. Yano, Naperville, Ill.

[73] Assignee: Bell Telephone Laboratories, Incorporated, Murray Hill, N.J.

[21] Appl. No.: 876,613

[22] Filed: Feb. 10, 1978

[51] Int. Cl.[2] ..... H01H 1/66; H01H 51/27

[52] U.S. Cl. ..... 335/154; 335/151

[58] Field of Search ..... 335/151, 152, 153, 154

[56] References Cited

U.S. PATENT DOCUMENTS

| | | | |
|---|---|---|---|
| 2,929,895 | 3/1960 | Shebanow | 335/153 |
| 3,254,173 | 5/1966 | Prival | 335/154 |
| 3,259,715 | 7/1966 | Wagar | 335/154 |
| 3,261,942 | 7/1966 | Wessel | 335/153 |
| 3,462,718 | 8/1969 | Takei | 335/154 |
| 3,535,663 | 10/1970 | Herzog et al. | 335/151 |
| 3,967,369 | 7/1976 | Takano | 29/622 |
| 4,031,494 | 6/1977 | Archer | 335/154 |

*Primary Examiner*—Fred L. Braun

*Attorney, Agent, or Firm*—William H. Kamstra

[57] ABSTRACT

An electrical reed spring relay construction in which a single pair of reed springs are controlled to complete simultaneously two distinct conducting paths. A pair of yoke members each comprising a pair of parallel legs connected at one end by a transverse base member are suspended by the other ends of the legs at opposite ends of an encapsulating envelope. Between the legs of each yoke member is arranged a reed spring member also suspended at one end of the envelope. The yoke assemblies are suspended at the envelope ends so that the other ends and base members overlap and are spaced apart to present the contact gaps. Upon the application of a magnetic field, the other end of the reed spring member of each yoke member is urged into contact with the base member of the other yoke member. Two distinct conducting paths are thus completed between opposite ends of the envelope: one via the reed spring member lying between the legs of one yoke member and a leg of the other yoke member and the other via the reed spring member lying between the legs of the latter yoke member and a leg of the former yoke member. In a second embodiment, the terminal elements of each conducting path emerge at the same end of the envelope. The transverse base member of each yoke is interrupted and the reed springs are operative to make connections between the yoke member legs which form the conducting paths.

11 Claims, 7 Drawing Figures

TWIN PATH REED SPRING RELAY CONSTRUCTION

BACKGROUND OF THE INVENTION

This invention relates to electromagnetically actuated electrical relays and more particularly to such relays having spring mounted contacts sealed in an enclosing envelope.

Sealed contact relays are well-known in the electrical arts and have long-found extensive application in electrical systems for performing a wide range of switching functions. These relays typically take the form of a pair of reed springs of a magnetically responsive and electrically conductive material suspended at their ends by the envelope, of a non-conductive material, usually, glass, in which they are sealed. At their other ends the springs overlap and are spaced apart to present a contact gap. A winding encircling the envelope is energizable to generate a magnetic field for urging the overlapping ends of the reed springs each toward the other to make electrical contact and thereby to control the electrical circuit in which the relay is connected. Although sealed reed relays having more than two spring pairs for controlling multiple electrical circuits are known, the relay form most generally available and in widest use incorporates only one spring pair to control the electrical continuity of a single conducting path. Thus, where two or more circuits are to be simultaneously controlled, such as the tip and ring circuits of a telephone subscriber line, for example, separate relays are generally provided to control the individual circuits. Problems attending the fabrication of most known multiconducting path relays, such as contact gap control and the like, have heretofore occasioned the provision of individual relays for multiple circuit control as the most economically feasible.

It is an object of the present invention to provide a new and novel sealed reed spring relay for simultaneously controlling a plurality of conducting paths.

Another object of this invention is a new and novel reed spring relay construction which lends itself to simplified fabrication techniques, offers versatility of operation, and achieves plural conducting paths without adding substantially to its power requirements.

SUMMARY OF THE INVENTION

The foregoing and other objects of this invention are realized in one illustrative relay emobidiment thereof comprising a pair of opposing contacting mechanisms each comprising an extended "U" shaped yoke between which a compliant reed contact spring is arranged. The reeds and yokes are conventionally of a magnetically responsive, electrically conductive material. Each contacting mechanism is suspended by the yoke legs and reed spring end at opposite ends of an enclosing envelope so that the bases of the "U"shaped yokes overlap well beyond their positions of coincidence in a spaced-apart relationship. The yoke leg and reed spring ends extend externally beyond the envelope ends to form the relay terminals. Upon the energization of a winding encircling the envelope, the magnetic field created causes the closure of the contact end of a reed spring of one contacting mechanism upon the base of the yoke of the opposing contacting mechanism. Two distinct conducting paths are thus completed: one through one reed spring and its opposing yoke, the other through the other yoke and its opposing reed spring. The yoke members are relatively noncompliant as compared with the flexible reed springs. As a result, only the opposing reed springs are operated by the applied magnetic field as in conventional reed spring relays while advantageously completing two conducting paths, the power requirements remaining substantially the same.

In an alternate arrangement according to the principles of this invention, a dual conducting path reed spring relay is realized in which the external terminals for each path appear at the same end of the envelope. In this arrangement, the bases of each "U" shaped yoke member is interrupted at its contact area. The flexible reed springs then serve only to complete electrical connections between the two pairs of yoke halves, the springs themselves not forming parts of the conducting paths.

It is thus one feature of this invention, that a single pair of opposing reed springs serves to complete two distinct electrical conducting paths within a single relay envelope.

The operating mechanisms of a relay construction according to this invention advantageously lend themselves to mass production techniques such as by stamping large numbers from a single blank of suitable material in one operation. The central reed spring members are rendered compliant by selectively reducing their thickness and assembly of the relay is facilitated by retaining the contacting mechanisms attached to the blank carrier until after encapsulation of the relay elements after which the carrier is severed to create the relay external terminals.

BRIEF DESCRIPTION OF THE DRAWING

The organization and operation of a relay construction according to the principles of this invention together with its objects and features will be better understood from a consideration of the detailed description of illustrative embodiments thereof which follows when taken in conjunction with the accompanying drawing in which.

DETAILED DESCRIPTION

Figure 1:
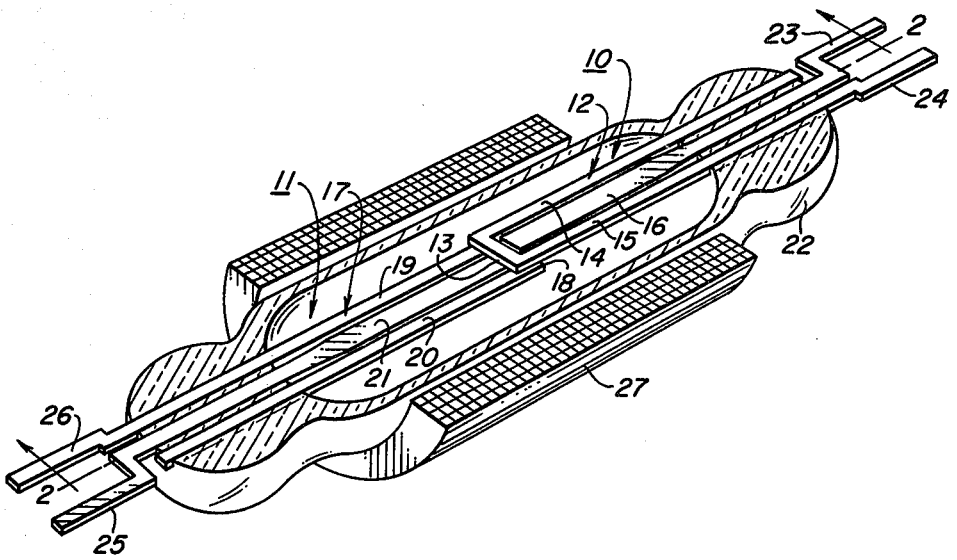
FIG. 1 depicts in perspective sectional view the organization of one illustrative relay assembly according to the principles of this invention.

One illustrative relay construction according to the principles of this invention is depicted in FIG. 1 and comprises a pair of identical contacting mechanisms 10 and 11 formed of a suitable electrically conductive, magnetically responsive material. Each of the mechanisms 10 and 11 comprises, as indicated with reference to mechanism 10, a substantially "U" shaped yoke member 12 having a base 13 connecting a pair of parallel legs 14 and 15. Lying between the legs 14 and 15 and substantially parallel therewith, is a first reed spring member 16, one end of which is disposed adjacent but not touching, the inner surface of base 13.

Contacting mechanism 11 similarly comprises a second substantially "U" shaped yoke member 17 having a base 18 (only partially visible in FIG. 1) connecting a pair of parallel legs 19 and 20. Lying between legs 19 and 20 and substantially parallel therewith, is a second reed spring member 21, one end of which is disposed adjacent but not touching, the inner surface of base 18. The ends of the yoke legs and the other ends of the reed springs extend through and are supported by, opposite ends of an encapsulating envelope 22 which may be formed of any suitable insulating material such as glass. At each end of envelope 22, external terminals are formed by the other ends of reed springs 16 and 21 and one leg of each of the yoke mechanisms 10 and 11. Thus, reed spring 16 is extended to present a terminal 23 and leg 15 is extended to present a terminal 24. Similarly, reed spring 21 is extended to present a terminal 25 and leg 19 is extended to present a terminal 26. Conventionally, the usually substantially circularly cross-sectioned envelope 22 is encircled by a cylindrical winding assembly 27.

As mentioned hereinbefore, the yoke mechanisms 10 and 11 may be stamped from a blank sheet to form the reed springs and yokes and such a stamping operation is contemplated as having been employed to realize the relay elements shown in FIG. 1 and other figures of the drawing. The particular terminal ends are accordingly formed as shown only as a result of a convenient blank lay-out of the contacting mechanisms. Yoke members 12 and 17 are relatively rigid as compared with the compliance of reed spring members 16 and 21, flexibility of the latter members being achieved during their fabrication by flattening, and thereby reducing the thickness of, their lengths from their supported ends. This is more clearly shown in the cross-sectional view of FIG. 2, to which figure reference may now be had for a description of an illustrative operation of the relay assembly of FIG. 1.

Figure 2:
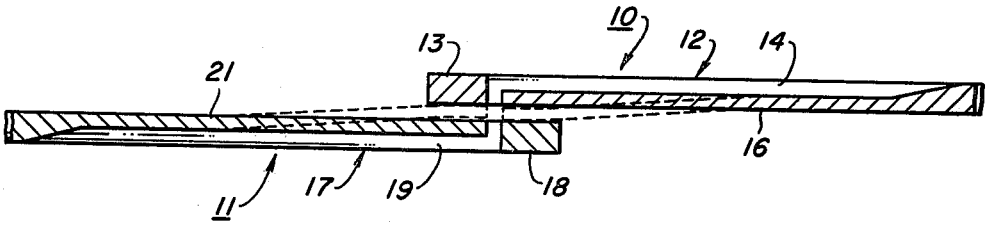
FIG. 2 is a cross-sectional view of the contacting mechanisms of the relay assembly of FIG. 1 taken along the line 2—2.

As depicted in FIG. 2, the contacting mechanisms 10 and 11 are supported at their envelope ends in a manner so as to dispose their opposite ends in an overlapping and spaced-apart relationship. The extent of the overlap is sufficient to extend the reed spring ends substantially to the inner sides of bases 13 and 18. When the winding of assembly 27 is energized, the magnetic field generated conventionally closes through the reed springs 16 and 21 and yokes 12 and 17 to create opposite poles at the overlapping ends of these elements. As a result, the end of reed spring 16 closes on base 18 of yoke 17 and reed spring 21 closes on base 13 of yoke 12. The operated positions of reed spring members 16 and 21 are shown in dashed outline in the figure. Two distinct conducting paths are thus created within the relay assembly which may be traced as follows (FIG. 1): a first path from terminal 23, reed spring 16, base 18, and leg 19 of yoke 17, to terminal 26, and a second, from terminal 25, reed spring 21, base 13 and leg 15 of yoke 12, to terminal 24. Upon de-energization of the winding of assembly 27, the reed springs are conventionally restored to break the conducting paths for nonlatching operation. It will be appreciated that a latching relay may be realized within the scope of this invention by adding the specification that the contacting mechanisms be formed of a magnetic material also exhibiting substantially rectangular hysteresis characteristics.

Figure 3:
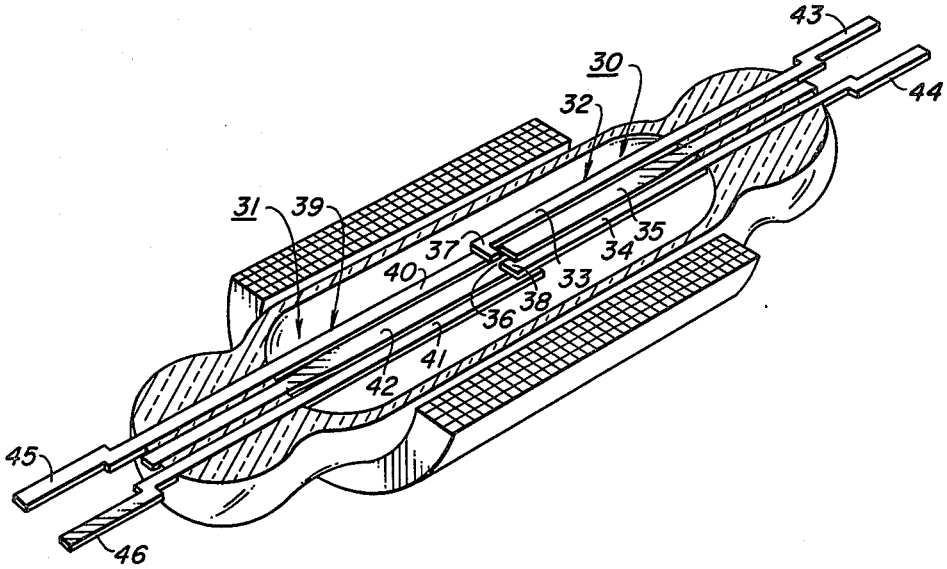
FIG. 3 depicts in perspective sectional view the organization of a second illustrative relay assembly according to the principles of this invention.

In the illustrative relay assembly of FIG. 1, it may be noted that the ends of two conducting paths as traced in the foregoing emerge from opposite ends of the envelope 22. In a second illustrative relay embodiment according to the principles of this invention, the two terminals of each conducting path emerge from the same end of the enclosing envelope. This relay assembly as shown in FIG. 3 also comprises a pair of contacting mechanisms 30 and 31. Mechanism 30 comprises a yoke member 32 having a pair of substantially parallel legs 33 and 34 between which is disposed a reed spring member 35. The base of yoke member 32 is interrupted to present a gap 36 between a pair of inwardly extending fingers 37 and 38. Mechanism 31 similarly comprises a a yoke member 39 having a pair of substantially parallel legs 40 and 41 between which is disposed a second reed spring member 42. The base of yoke member 39 is also interrupted to present a gap between a pair of inwardly extending fingers not visible in FIG. 3. Each of the legs of the yoke leg pairs 32–39 and 40–41 is individually extended beyond the ends of the envelope to present at the ends, respectively, terminals 43 and 44 and terminals 45 and 46. Reed spring members 35 and 42 are merely supported at the envelope ends and, as will appear hereinafter, do not provide for external electrical connections. Reed spring members 35 and 42 are also flattened to achieve flexibility as compared to the relatively rigid yoke leg members as in the embodiment of FIG. 1. Each of the remaining elements of the relay embodiment of FIG. 3 is identical to its counterpart in the relay assembly of FIG. 1.

The operating ends of the contacting mechanisms of the relay embodiment of FIG. 3 also overlap and are spaced-apart to present contact gaps. In this embodiment, however, as the winding is energized and a magnetic field is applied to the contacting mechanisms, the reed spring member of one contacting mechanism completes an electrical connection between the yoke fingers of the other mechanism. Thus, as reed spring member 35 is operated, a connection is completed between the fingers (not visible in the drawing) extending inwardly from the yoke legs 40 and 41. Similarly, as reed spring member 42 is operated, a connection is completed between the fingers 37 and 38 extending inwardly from yoke legs 33 and 34. Two distinct conducting paths are thus again completed by a single pair of reed spring members, which paths may be traced as follows: a first path from terminal 43 to terminal 44 at the same end of the enclosing envelope via yoke leg 33, its finger 37, the end of reed spring member 42, finger 38, and yoke leg 34; a second path from terminal 45 to terminal 46 at the same but opposite end of the enclosing envelope via yoke leg 40, its finger, the end of reed spring member 35, the finger of yoke leg 41, and the latter leg.

Figure 4:
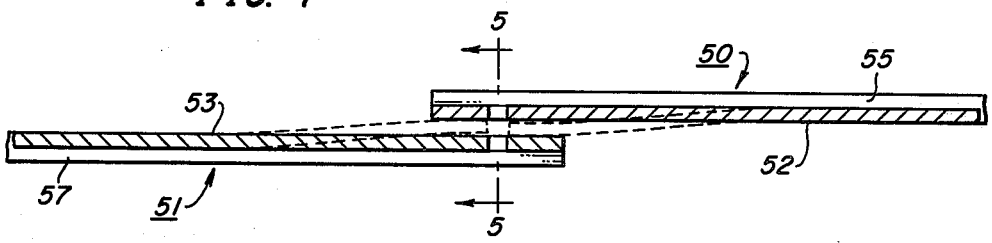
FIG. 4 is a cross-sectional view of a pair of contacting mechanisms according to this invention depicting a specific structural variation.
Figure 5:
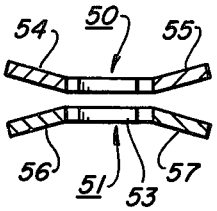
FIG. 5 is a cross-sectional view of the contacting mechanisms of FIG. 4 taken along the line 5—5.
Figure 6:
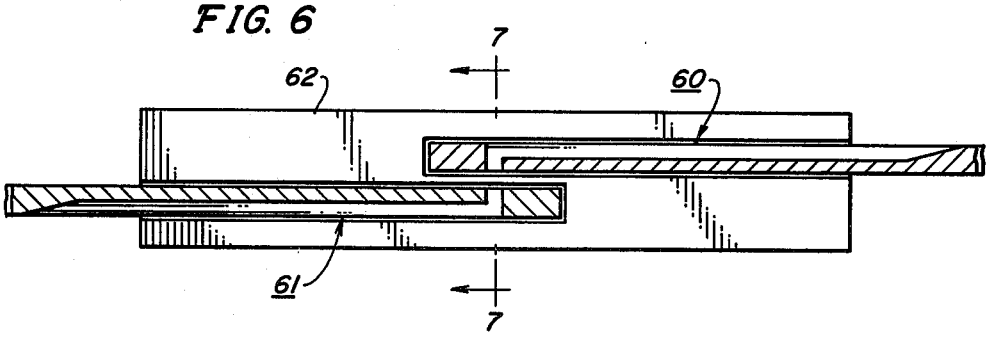
FIG. 6 is a cross-sectional view of a pair of contacting mechanisms according to this invention depicting a mounting arrangement to ensure the proper positioning and alignment of the elements.
Figure 7:
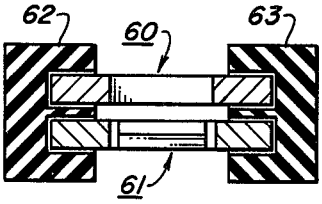
FIG. 7 is a cross-sectional view of the contacting mechanisms of FIG. 6 taken along the line 7—7.

Advantageously, structural variations may be incorporated in a relay assembly construction within the scope of this invention to facilitate assembly and to ensure proper positioning and alignment of its parts. Thus, in FIG. 4 is shown in length-wise cross-section a pair of contacting mechanisms 50 and 51 of a relay arrangement according to the embodiment of FIG. 1 formed of a sheet blank of reduced thickness thereby obviating the flattening step to achieve the desired compliance of the reed spring members 52 and 53. Rigidity of the yoke members is then achieved by oppositely flaring the yoke legs as depicted in the cross-sectional view of FIG. 5 as the oppositely flared legs 54–55 and 56–57. In another assembly arrangement within the scope of this invention, contacting mechanisms 60 and 61 are mounted within a pair of insulating spacers 62 and 63 also shown in the sectional views of FIGS. 6 and 7. The relative positions of the yoke members are thus positively ensured and the insertion of the subassembly as a unit within a protective envelope is facilitated. Further, although not shown in the drawing, the thickness of the sheet blank from which the mechanisms may be formed may also be reduced without regard for yoke rigidity since the yoke members are secured from movement by the spacers 62 and 63.

What have been described are considered to be only specific illustrative relay assemblies according to the principles of this invention and it is to be understood that various and numerous other arrangements may be devised by one skilled in the art without departing from the spirit and scope of the invention as defined by the accompanying claims.

What is claimed is:

1. An electrical relay construction comprising a first and a second electrically conductive, magnetically responsive contacting mechanism, each comprising a yoke means having a pair of substantially parallel legs having a contact means therebetween at one end, each of said yoke means being suspended at the other ends of said legs to maintain the contact means of one yoke means in a spaced-apart and overlapping relation with the contact means of the other yoke means, and a first and second reed spring member positioned between the legs of the yoke means of each of said mechanisms, respectively, said reed spring members being also of a magnetically responsive, electrically conductive material, each of said reed spring members being suspended at one end at the other ends of said legs to maintain the other end of the reed spring member of each of said mechanisms in a spaced-apart and overlapping relation with the contact means of the other of said mechanisms.

2. An electrical relay construction as claimed in claim 1 in which said contact means of each of said mechanisms comprises a base member bridging said pair of parallel legs at said one end, each of said reed spring members being flexible responsive to an applied magnetic field to cause the other end of the reed spring member of each of said mechanisms to contact said base member of the other of said mechanisms.

3. An electrical relay construction as claimed in claim 1 in which said contact means of each of said mechanisms comprises a pair of fingers extending inwardly from said legs of said pair of legs at said one end, each of said reed spring members being flexible responsive to an applied magnetic field to cause the other end of the reed spring member of each of said mechanisms to contact said pair of fingers of the other of said mechanisms.

4. An electrical relay construction comprising a first and a second electrically conductive contacting mechanism each comprising a yoke member having a pair of substantially parallel legs connected at one end by a transverse base member and a magnetically responsive reed spring member positioned between said parallel legs, each of said mechanisms being suspended at the other ends of said pair of legs and one end of said reed spring member to maintain said base member of one yoke member in a spaced-apart and overlapping relation with said base member of the other yoke member and to maintain the other end of said reed spring members of each of said mechanisms in a spaced-apart and overlapping relation with said base member of the other of said mechanisms.

5. An electrical relay construction as claimed in claim 4 also comprising an electrically insulated envelope for enclosing said first and second contacting mechanisms, said other ends of said pair of legs and said one end of said reed spring member of each of said contacting mechanisms, respectively, being suspended at opposite ends of said envelope.

6. An electrical relay construction as claimed in claim 5 also comprising winding means inductively coupled to said first and second contacting mechanism, said winding means being energizable to apply a magnetic field to said contacting mechanisms to cause the other end of the reed spring member of each of said mechanisms to contact said transverse base member of the other of said mechanisms.

7. An electrical relay construction as claimed in claim 6 also comprising a pair of terminals at said opposite ends of said envelope, each of said pairs of terminals comprising an extension through said envelope of one leg of one of said yoke members and an extension through said envelope of said end of one of said reed spring members.

8. An electrical relay construction comprising a first and second electrically conductive contacting mechanism each comprising a yoke means having a pair of substantially parallel legs having, respectively, a pair of fingers inwardly extending at one end therefrom, and a magnetically responsive reed spring member positioned between said parallel legs, each of said mechanisms being suspended at the other ends of said pair of legs and one end of said reed spring member to maintain said fingers of one yoke means in a spaced-apart and overlapping relation with said fingers of the other yoke means and to maintain the other end of said reed spring member of each of said mechanisms in a spaced-apart and overlapping relation with said fingers of the other of said mechanisms.

9. An electrical relay construction as claimed in claim 8 also comprising an electrically insulated envelope for enclosing said first and second contacting mechanisms, said other ends of said pair of legs and said one end of said reed spring member of each of said contacting mechanisms, respectively, being suspended at opposite ends of said envelope.

10. An electrical relay construction as claimed in claim 9 also comprising winding means inductively coupled to said first and second contacting mechanisms, said winding means being energizable to apply a magnetic field to said contacting mechanisms to cause the other end of the reed spring member of each of said mechanisms to contact both of said fingers of the other of said mechanisms.

11. An electrical relay construction as claimed in claim 10 also comprising a pair of terminals at said opposite ends of said envelope, each of said pairs of terminals comprising an extension through said envelope of both of said legs of one of said yoke members.

* * * * *